US008913916B2

(12) United States Patent
Kawamata et al.

(10) Patent No.: US 8,913,916 B2
(45) Date of Patent: Dec. 16, 2014

(54) DEVELOPER, IMAGE-FORMING APPARATUS, AND METHOD FOR FORMING IMAGE

(71) Applicant: Fuji Xerox Co., Ltd., Tokyo (JP)

(72) Inventors: Shinichi Kawamata, Ebina (JP); Kunihiko Sato, Ebina (JP); Sakon Takahashi, Ebina (JP); Nobumasa Furuya, Ebina (JP); Kazuhiko Arai, Ebina (JP); Masaaki Takahashi, Ebina (JP); Koji Nishimura, Ebina (JP); Daisuke Haruyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 35 days.

(21) Appl. No.: 13/893,850

(22) Filed: May 14, 2013

(65) Prior Publication Data

US 2014/0126927 A1 May 8, 2014

(30) Foreign Application Priority Data

Nov. 2, 2012 (JP) ..... 2012-242656

(51) Int. Cl.
*G03G 21/00* (2006.01)
*G03G 15/00* (2006.01)

(52) U.S. Cl.
CPC ..... *G03G 21/0064* (2013.01); *G03G 15/751* (2013.01)
USPC ..... 399/99; 399/302; 399/101; 399/222; 399/111; 399/119

(58) Field of Classification Search
USPC ..... 399/99, 302, 101, 222, 111, 119
See application file for complete search history.

(56) References Cited

U.S. PATENT DOCUMENTS

| | | | | |
|---|---|---|---|---|
| 2005/0130050 | A1 | 6/2005 | Takada et al. | |
| 2010/0209149 | A1 * | 8/2010 | Hara et al. | 399/298 |
| 2010/0261113 | A1 * | 10/2010 | Aruga et al. | 430/105 |

FOREIGN PATENT DOCUMENTS

| | | |
|---|---|---|
| JP | A-2005-172968 | 6/2005 |
| JP | A-2010-002748 | 1/2010 |

* cited by examiner

*Primary Examiner* — Walter L Lindsay, Jr.
*Assistant Examiner* — Roy Y Yi
(74) *Attorney, Agent, or Firm* — Oliff PLC

(57) ABSTRACT

A developer contains a toner having an external additive deposited thereon. The developer is used with an image-forming apparatus including an image carrier including a surface layer in which fluoropolymer resin particles are dispersed and a cleaning member disposed in contact with an outer surface of the image carrier. The external additive is a nonspherical external additive whose volume average particle size is smaller than the average particle size of exposed portions of the fluoropolymer resin particles in the surface layer of the image carrier.

15 Claims, 8 Drawing Sheets

DEVELOPER, IMAGE-FORMING APPARATUS, AND METHOD FOR FORMING IMAGE

CROSS-REFERENCE TO RELATED APPLICATIONS

This application is based on and claims priority under 35 USC 119 from Japanese Patent Application No. 2012-242656 filed Nov. 2, 2012.

BACKGROUND (i) Technical Field

The present invention relates to developers, image-forming apparatuses, and methods for forming images.

(ii) Related Art

Image-forming apparatuses, such as printers, copiers, and fax machines, that form an image with a developer may have the following intermediate transfer system.

Specifically, a type of image-forming apparatus is available that includes an intermediate transfer belt including a surface layer in which fluoropolymer resin particles are dispersed for improved toner releasability and a cleaning device including a blade-shaped member. The intermediate transfer belt is rotated so as to transport an image developed with a developer containing a toner coated with an external additive and transferred to the outer surface of the intermediate transfer belt to a second transfer section that retransfers the toner image to a recording medium such as recording paper. The blade-shaped member is disposed in contact with the outer surface of the intermediate transfer belt that has passed through the second transfer section to remove residual toner therefrom.

SUMMARY

According to an aspect of the invention, there is provided a developer containing a toner having an external additive deposited thereon. The developer is used with an image-forming apparatus including an image carrier including a surface layer in which fluoropolymer resin particles are dispersed and a cleaning member disposed in contact with an outer surface of the image carrier. The external additive is a nonspherical external additive whose volume average particle size is smaller than the average particle size of exposed portions of the fluoropolymer resin particles in the surface layer of the image carrier.

BRIEF DESCRIPTION OF THE DRAWINGS

Exemplary embodiments of the present invention will be described in detail based on the following figures, wherein:

FIG. 9A is a graph showing measurements of fluorine coverage, and FIG. 9B is a graph showing measurements of silica coverage;

DETAILED DESCRIPTION

Exemplary embodiments of the present invention will now be described with reference to the drawings.

First Exemplary Embodiment

Figure 1:
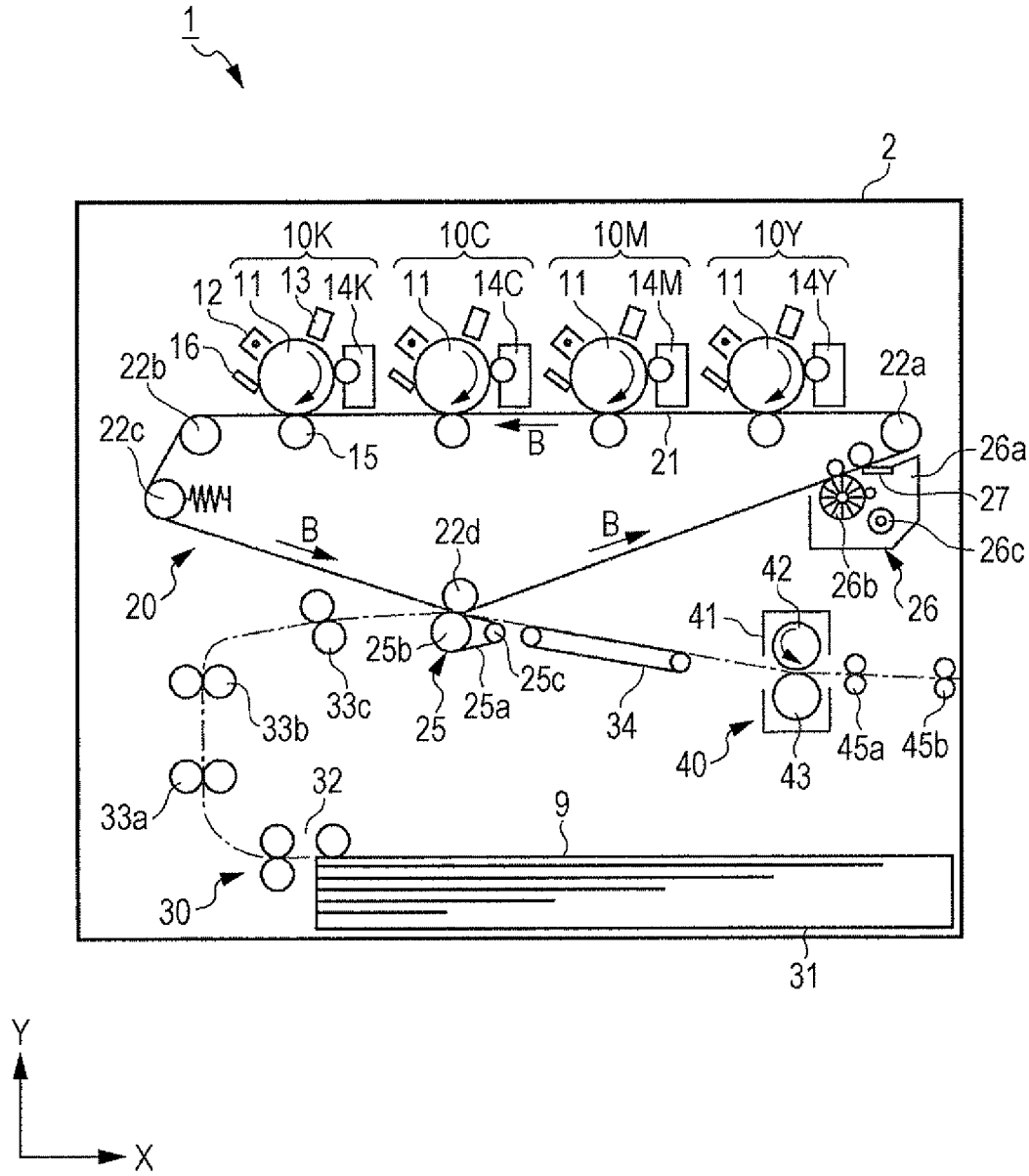
FIG. 1 is a schematic view of an image-forming apparatus according to a first exemplary embodiment and other exemplary embodiments.
Figure 2:
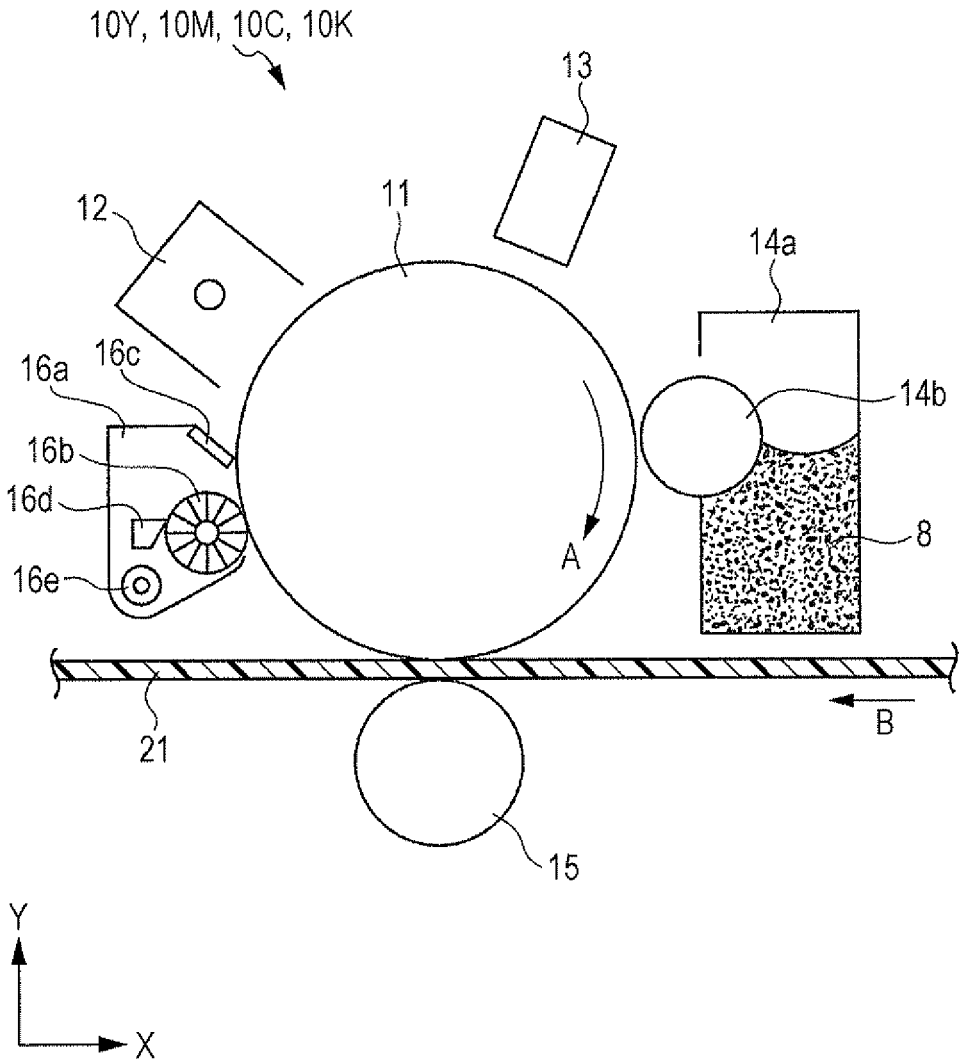
FIG. 2 is a schematic view of an image-forming device in the image-forming apparatus in FIG. 1.
Figure 3:
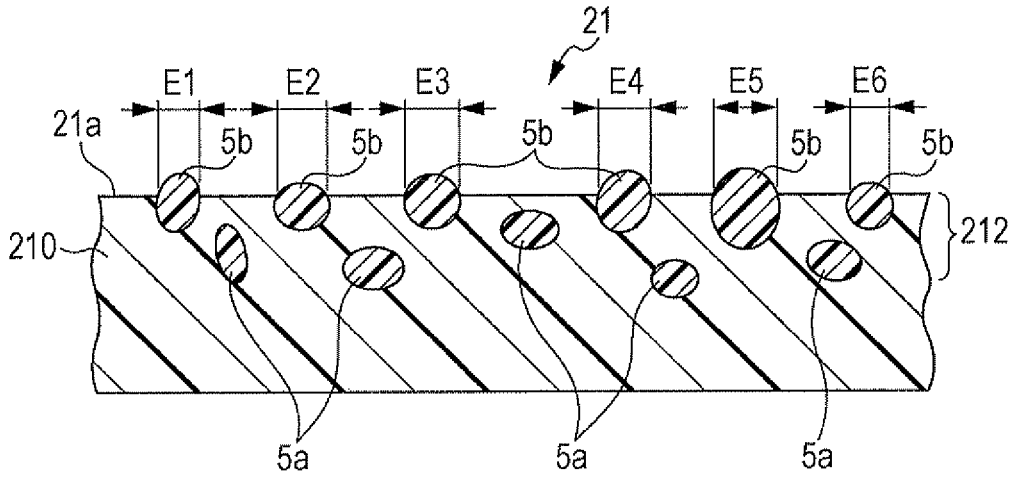
FIG. 3 is a schematic sectional view of an intermediate transfer belt in the image-forming apparatus in FIG. 1.

FIGS. 1 to 3 illustrate an image-forming apparatus according to a first exemplary embodiment. FIG. 1 schematically shows the image-forming apparatus. FIG. 2 shows an image-forming device in the image-forming apparatus. FIG. 3 shows a portion (cross-section) of an intermediate transfer belt in the image-forming apparatus.

An image-forming apparatus 1 according to the first exemplary embodiment is configured as, for example, a color printer. As shown in FIG. 1, the image-forming apparatus 1 includes a housing 2 accommodating image-forming devices 10, an intermediate transfer system 20, a paper feed device 30, and a fixing device 40. Each image-forming device 10 forms a toner image developed with a developer 8 containing a toner. The intermediate transfer system 20 carries the toner images formed by the image-forming devices 10 and finally transfers the toner images to recording paper 9, which is an example of a recording medium. The paper feed device 30 contains the recording paper 9 to be fed to the intermediate transfer system 20 and transports the recording paper 9 when necessary. The fixing device 40 fixes the toner images transferred to the recording paper 9 by the intermediate transfer system 20.

The image-forming devices 10 include an image-forming device 10Y that forms a yellow (Y) toner image, an image-forming device 10M that forms a magenta (M) toner image, an image-forming device 10C that forms a cyan (C) toner image, and an image-forming device 10K that forms a black (K) toner image. These four image-forming devices 10 (10Y, 10M, 10C, and 10K) are arranged in series in the housing 2. The image-forming devices 10 (10Y, 10M, 10C, and 10K) are composed of similar components, as described below.

As shown in FIGS. 1 and 2, each image-forming device 10 (10Y, 10M, 10C, or 10K) includes a photoreceptor drum 11 that rotates in the direction indicated by arrow A. The photoreceptor drum 11 is surrounded by the following devices: a charging device 12, an exposure device 13, a developing device 14 (14Y, 14M, 14C, or 14K), a first transfer device 15, and a drum-cleaning device 16. The charging device 12 charges an image-bearing surface (circumferential surface) of the photoreceptor drum 11 on which an image is formed to a predetermined potential. The exposure device 13 irradiates the charged circumferential surface of the photoreceptor drum 11 with light based on image information (signal) to form an electrostatic latent image with a potential difference (for the corresponding color). The developing device 14 develops the electrostatic latent image with the toner contained in the developer 8 of the corresponding color (Y, M, C, or K) to form a visible toner image. The first transfer device 15 transfers the toner image to the intermediate transfer system 20 (i.e., to an intermediate transfer belt thereof). The drum-cleaning device 16 cleans the image-bearing surface of the photoreceptor drum 11 after transfer by removing deposits such as residual toner therefrom.

The photoreceptor drum 11 includes a grounded solid or hollow cylindrical substrate and a photoconductive layer (photosensitive layer) disposed thereon. The photoconductive layer is formed of a photosensitive material and forms the image-bearing surface of the photoreceptor drum 11. The photoreceptor drum 11 rotates in the direction indicated by arrow A as it is driven by a rotational drive device (not shown). The charging device 12 is a noncontact charging device including a charging wire disposed at a predetermined distance from the image-bearing surface of the photoreceptor drum 11. The charging device 12 applies a charging current to the charging wire to charge the image-bearing surface of the photoreceptor drum 11 by corona discharge. Alternatively, the charging device 12 may be a contact charging device including a contact member such as a charging roller. The contact member is disposed in contact with the image-bearing surface of the photoreceptor drum 11 and is supplied with a charging bias. If the developing device 14 is configured for reversal development, the charging bias is a voltage or current of the same polarity as the toner supplied by the developing device 14.

The exposure device 13 irradiates the charged image-bearing surface of the photoreceptor drum 11 with light based on image information input to the image-forming apparatus 1 to form an electrostatic latent image. The exposure device 13 may be, for example, a nonscanning exposure device including a light-emitting diode and optical components or a scanning exposure device including a semiconductor laser and optical components such as a polygon mirror. An image processor (not shown) processes the image information input to the image-forming apparatus 1 to generate an image signal for each color component and transmits the image signal to the exposure device 13.

The developing device 14 (14Y, 14M, 14C, or 14K) uses a two-component developer 8 containing a toner and a carrier. As shown in FIG. 2, the developing device 14 agitates a two-component developer 8 of the corresponding color contained in a container-like housing 14*a* with an agitating transport member (not shown) so that the developer 8 is triboelectrically charged to a predetermined polarity. The charged developer 8 is carried by a rotating developing roller 14*b* that is supplied with a developing bias and is supplied to a developing area opposite the photoreceptor drum 11 to develop the latent image formed on the photoreceptor drum 11. The first transfer device 15 is a contact transfer device that rotates in contact with the image-bearing surface of the photoreceptor drum 11 and that includes a first transfer roller that is supplied with a first transfer bias. The first transfer bias is, for example, a direct-current voltage of the opposite polarity as the developer 8 and is applied by a power supply for transfer (not shown).

The drum-cleaning device 16 includes a container-like housing 16*a, a* rotating brush 16*b, a* cleaning blade 16*c, a* flicker 16*d*, and a collecting transport member 16*e*. The rotating brush 16*b* rotates with its brush member in contact with the circumferential surface of the photoreceptor drum 11 after first transfer. The cleaning blade 16*c* is disposed downstream of the rotating brush 16*b* in the rotational direction in contact with the circumferential surface of the photoreceptor drum 11 under a predetermined pressure to scrape off deposits such as residual toner. The flicker 16*d* flicks the deposits off the rotating brush 16*b*. The collecting transport member 16*e*, such as a screw auger, collects and transports the deposits flicked off the brush member of the rotating brush 16*b* to *a* collection system (not shown). The cleaning blade 16*c* is a blade-shaped or substantially blade-shaped member formed of, for example, a flexible rubber or resin.

As shown in FIG. 1, the intermediate transfer system 20 is disposed under the image-forming devices 10 (10Y, 10M, 10C, and 10K). The intermediate transfer system 20 includes an intermediate transfer belt 21, support rollers 22*a* to 22*d, a* second transfer device 25, and a belt-cleaning device 26. The intermediate transfer belt 21 rotates (circulates) in the direction indicated by arrow B while passing through first transfer positions between the photoreceptor drums 11 and the first transfer devices 15 (first transfer rollers). The support rollers 22*a* to 22*d* support the intermediate transfer belt 21 from inside so as to be rotatably held in a predetermined state. The second transfer device 25 rotates in contact with the outer surface (image-bearing surface) 21*a* of the intermediate transfer belt 21 at the position supported by the support roller 22*d* under a predetermined pressure. The belt-cleaning device 26 cleans the outer surface 21*a* of the intermediate transfer belt 21 by removing deposits such as residual developer and paper dust therefrom after it passes through the second transfer device 25. Among the support rollers 22*a* to 22*d* supporting the intermediate transfer belt 21, the support roller 22*a* functions as a drive roller, the support roller 22*c* functions as a tension roller, and the support roller 22*d* functions as a second transfer support roller.

As shown in FIG. 3, the intermediate transfer belt 21 is an endless belt including a belt substrate 210 and fluoropolymer resin particles 5 dispersed therein for improved toner (image) releasability (i.e., for reduced adhesion to a toner image). The belt substrate 210 is formed of a synthetic resin, such as a polyimide or polyamide resin, in which a resistivity modifier, such as carbon black, is dispersed. The fluoropolymer resin particles 5 are dispersed in the belt substrate 210 so as to be present at least in a surface layer portion that forms the outer surface 21*a* of the intermediate transfer belt 21. The fluoropolymer resin particles 5 present in the surface layer portion include those buried in the belt substrate 210 (resin layer) without being exposed in the outer surface 21*a* of the intermediate transfer belt 21, as illustrated by reference numeral 5*a* in FIG. 3, and those partially exposed in the outer surface 21*a* of the intermediate transfer belt 21, as illustrated by reference sign 5*b* in FIG. 3.

The intermediate transfer belt 21 is fabricated by, for example, forming a surface layer 212 in which the fluoropolymer resin particles 5 are dispersed on the outer surface of the belt substrate 210. The surface layer 212 is formed by, for example, preparing a polyamic acid solution in which the fluoropolymer resin particles 5 and additives such as carbon black are dispersed as a layer-forming material, applying the layer-forming material to the outer surface of the belt substrate 210, and drying the coating. The polyamic acid solution used as the layer-forming material may be, for example, a mixture of a polyamic acid solution in which carbon black is dispersed and a polyamic acid solution in which the fluoropolymer resin particles 5 are dispersed, which is imidized to prepare a polyimide resin. Alternatively, the intermediate transfer belt 21 may be fabricated by, for example, adding a fluoropolymer resin to the material for forming the belt substrate 210 and molding the material. This type of intermediate transfer belt 21 has some fluoropolymer resin particles 5 segregated in the surface layer portion of the belt substrate 210.

The fluoropolymer resin particles 5 are formed of a fluoropolymer resin such as polytetrafluoroethylene (PTFE). The fluoropolymer resin particles 5 are relatively fine particles with an average particle size of 100 to 300 nm so that they are uniformly dispersed in the intermediate transfer belt 21. The amount of fluoropolymer resin particles 5 added to the belt substrate 210 is preferably 0.2% to 30%, more preferably 1% to 15%. If the amount of fluoropolymer resin particles 5 added is less than 0.2%, the intermediate transfer belt 21 exhibits increased adhesion to a toner image and thus has decreased transfer efficiency. If the amount of fluoropolymer resin particles 5 added is more than 30%, the intermediate transfer belt 21 might warp and deform due to thermal contraction when cooled during the manufacturing process. For improved efficiency of transfer of a toner image from the intermediate transfer belt 21 to the recording paper 9, the outer surface 21*a* of the intermediate transfer belt 21 may have a surface roughness (10-point average roughness, Ra) of less than 0.5 and a static friction coefficient of less than 1.0.

The second transfer device 25 includes an endless second transfer belt 25*a*, *a* drive roller 25*b*, and at least one driven roller 25*c*. The second transfer belt 25*a* is entrained about the drive roller 25*b* and the driven roller 25*c* and is arranged to rotate in a predetermined direction. The drive roller 25*b* rotates in contact with the outer surface 21*a* (image-bearing surface) of the intermediate transfer belt 21 at the position supported by the second transfer support roller 22*d* under a predetermined pressure. The driven roller 25*c* (or the second transfer belt 25*a*) is supplied with a second transfer bias from a power supply for transfer (not shown). The second transfer bias is, for example, a direct-current voltage of the same (or opposite) polarity as the developer 8. The second transfer belt 25*a* is formed of, for example, a synthetic resin such as a polyimide or polyamide resin.

As shown in FIG. 1, the belt-cleaning device 26 is disposed along the outer surface 21*a* of the intermediate transfer belt 21 at a predetermined position between the second transfer device 25 and the support roller 22*a*, which functions as a drive roller. The belt-cleaning device 26 includes a box-shaped housing 26*a* having a top opening opposite the intermediate transfer belt 21. The housing 26*a* accommodates a cleaning blade 27, a rotating brush 26*b*, and a collecting transport member 26*c*. The cleaning blade 27 is, for example, a substantially rectangular elastic blade formed of an elastic material such as rubber or resin. The cleaning blade 27 is attached to the housing 26*a* with the leading edge thereof in contact with the outer surface 21*a* of the intermediate transfer belt 21. The cleaning blade 27 is set so as to apply a contact load of 4.9 to 49.0 N/m to the outer surface 21*a* of the intermediate transfer belt 21. Back support rollers are disposed on the inner surface (inner circumferential surface) of the intermediate transfer belt 21 opposite the cleaning blade 27 and the rotating brush 26*b*.

The paper feed device 30 is disposed under the intermediate transfer system 20. The paper feed device 30 includes at least one paper feed container 31 that contains a stack of recording paper 9 of a predetermined size and type and a feeder 32 that feeds the recording paper 9 from the paper feed container 31 sheet by sheet. The fixing device 40 includes a housing 41 accommodating a heating rotor 42 and a pressing rotor 43. The heating rotor 42 rotates in the direction indicated by the arrow and is heated by a heater so that the surface thereof is maintained at a predetermined temperature. The pressing rotor 43 is rotated in contact with the heating rotor 42 substantially along the axis thereof under a predetermined pressure.

Also provided in the housing 2 of the image-forming apparatus 1 is a feed transport path formed between the paper feed device 30 and the second transfer position (where the intermediate transfer belt 21 is disposed in contact with the second transfer device 25) of the intermediate transfer system 20 by pairs of paper transport rollers 33*a*, 33*b*, 33*c*, . . . and transport guide members. A paper transport device 34, such as a belt transport device, is disposed between the second transfer device 25 and the fixing device 40 to transport the recording paper 9 to the fixing device 40 after second transfer. A discharge transport path is formed on the discharge side of the fixing device 40 by pairs of transport rollers 45*a* and 45*b* and transport guide members. A paper output container (not shown) for containing the recording paper 9 discharged from the discharge transport path after image formation is disposed, for example, outside the housing 2.

As described above, the two-component developer 8 for use with the image-forming apparatus 1 (in practice, the developing devices 14) contains a toner and a carrier. The two-component developer 8 is used as a mixture of the toner and the carrier in a predetermined ratio.

Typically, the toner is a nonmagnetic toner. The nonmagnetic toner is composed of toner particles and an external additive deposited on the surface thereof to provide the desired function. The toner particles contain a known binder resin, a colorant, and optionally other additives such as a release agent. The binder resin is, for example, a polyester or acrylic resin. Examples of other additives include release agents, magnetic materials, charge control agents, and inorganic powders. The external additive may be inorganic or organic fine particles. Examples of inorganic fine particles include silica, titania, alumina, cerium oxide, strontium titanate, calcium carbonate, magnesium carbonate, and calcium phosphate. Examples of organic fine particles include fluorine-containing resin fine particles, silica-containing resin fine particles, and nitrogen-containing resin fine particles. The external additive may be surface-treated with a hydrophobing agent such as a silane compound, a silane coupling agent, or silicone oil. Other properties of the external additive will be described later. The method for manufacturing the toner particles may be, for example, but not limited to, a known emulsification polymerization aggregation process. The nonmagnetic toner is manufactured by mixing the toner particles and the external additive in, for example, a Henschel mixer or a V-blender. The nonmagnetic toner may have a volume average particle size of 3 to 6 μm.

The magnetic carrier may be, for example, a carrier formed of a magnetic material, a coated carrier prepared by coating cores formed of a magnetic powder with a coating resin, a magnetic-powder-dispersed carrier prepared by dispersing a magnetic powder in a matrix resin, or a resin-impregnated carrier prepared by impregnating a porous magnetic powder with a resin. Examples of magnetic powders include magnetic metals such as iron, nickel, and cobalt and magnetic oxides such as ferrite and magnetite. Examples of coating resins and matrix resins include polyethylene, polypropylene, and polystyrene. The carrier may have a volume average particle size of, for example, 20 to 40 μm.

Next, the basic image-forming operation of the image-forming apparatus 1 will be described. Described herein is an image-forming operation pattern (full-color mode) in which a full-color image composed of toner images of the four colors (Y, M, C, and K) is formed using all the four image-forming devices 10 (10Y, 10M, 10C, and 10K).

When the image-forming apparatus 1 receives a request for image-forming operation (printing), the photoreceptor drum 11 of each of the four image-forming devices 10 (10Y, 10M, 10C, and 10K) rotates in the direction indicated by arrow A, and the charging device 12 charges the image-bearing surface of the photoreceptor drum 11 to a predetermined polarity and potential. The exposure device 13 then irradiates the charged image-bearing surface of the photoreceptor drum 11 with light emitted based on image data separated for different color components (Y, M, C, and K), which is received from the image processor, to form an electrostatic latent image with a predetermined potential difference for the corresponding color component. The developing device 14 (14Y, 14M, 14C, or 14K) then supplies the two-component developer 8 of the corresponding color (Y, M, C, or K), which is charged to a predetermined polarity, to the electrostatic latent image formed on the photoreceptor drum 11 to cause the toner to be electrostatically attracted to the electrostatic latent image. Thus, each image-forming device 10 forms a toner image of any of the four colors (Y, M, C, and K) on the image-bearing surface of the photoreceptor drum 11.

The first transfer device 15 then transfers the toner image formed on the photoreceptor drum 11 by the image-forming device 10 (10Y, 10M, 10C, or 10K) to the outer surface 21*a* of the intermediate transfer belt 21, which rotates in the direction indicated by arrow B, in the intermediate transfer system 20 such that the toner images of the four colors are sequentially combined with each other. After the first transfer is completed, the image-bearing surface of each photoreceptor drum 11 is cleaned by the drum-cleaning device 16 to prepare for the next image-forming operation.

The intermediate transfer system 20 carries the toner images on the intermediate transfer belt 21 and transports the toner images to the second transfer position. The second transfer device 25 then simultaneously transfers the toner images from the intermediate transfer belt 21 to the recording paper 9 transported from the paper feed device 30 to the second transfer position through the feed transport path. After the second transfer is completed, the outer surface 21*a* of the intermediate transfer belt 21 is cleaned by the belt-cleaning device 26 to prepare for the next image-forming operation.

Finally, the recording paper 9 to which the toner images are transferred is released from the intermediate transfer belt 21 and is transported to the fixing device 40 by the paper transport device 34. The fixing device 40 fixes the toner images by fixing treatment (heating and pressing). For single-sided image-forming operation, the recording paper 9 to which the toner images are fixed is discharged outside the housing 2 through the discharge transport path and is stored in the paper output container.

By the operation described above, the image-forming apparatus 1 outputs recording paper 9 on which a full-color image composed of toner images of the four colors is formed.

Figure 4:
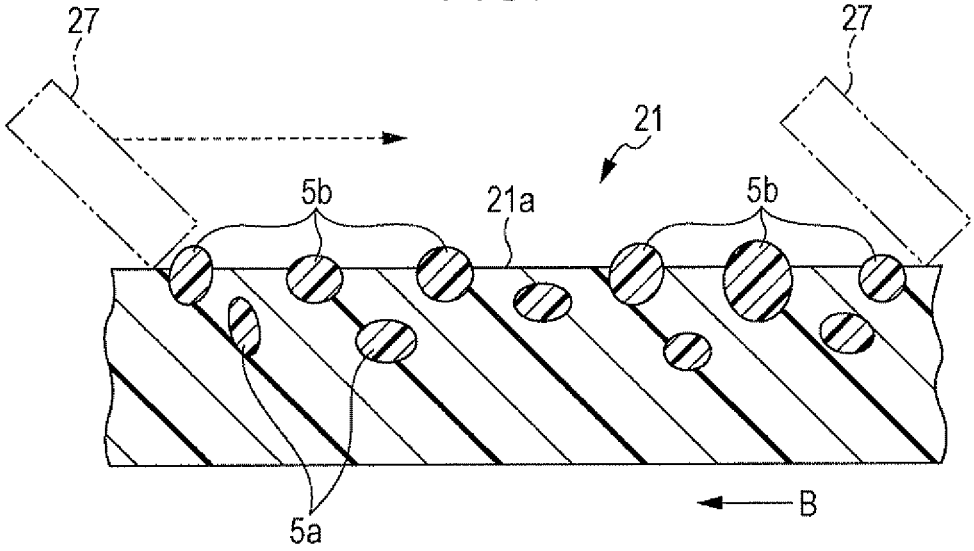
FIG. 4 is a schematic sectional view showing the intermediate transfer belt in FIG. 3 as being rubbed by a cleaning blade.

In the image-forming apparatus 1, as shown in FIG. 4, the cleaning blade 27 of the belt-cleaning device 26 continues to rub the outer surface 21*a* of the intermediate transfer belt 21 during the rotation of the intermediate transfer belt 21. For illustration purposes, FIG. 4 shows the states before and after the cleaning blade 27, which is fixed, moves relative to the outer surface 21*a* of the intermediate transfer belt 21 in contact therewith as the intermediate transfer belt 21 rotates in the direction indicated by arrow B.

Figure 5:
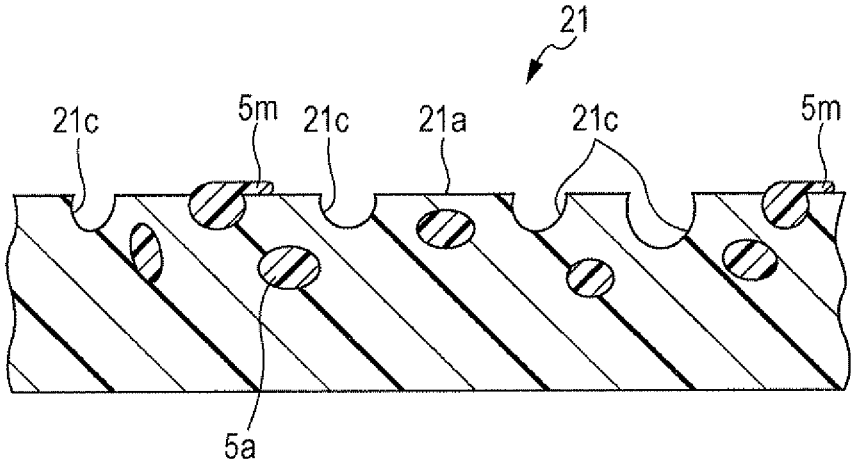
FIG. 5 is a schematic sectional view showing the intermediate transfer belt after being rubbed by the cleaning blade.

As illustrated in FIG. 5, some of the fluoropolymer resin particles 5*b* initially exposed in the outer surface 21*a* of the intermediate transfer belt 21 (including the fluoropolymer resin particles 5*a* exposed later as they are rubbed by the cleaning blade 27) come off as they are rubbed by the cleaning blade 27. The exposed portions of some other exposed fluoropolymer resin particles 5*b* are pressed into a thin film as they are rubbed by the cleaning blade 27 because of their property of being easily pressed. The pressed portions remain as thin films 5*m* on the outer surface 21*a* of the intermediate transfer belt 21.

As a result, some of the fluoropolymer resin particles 5*b* exposed in the outer surface 21*a* of the intermediate transfer belt 21 are lost, and there are accordingly fewer fluoropolymer resin particles 5 for improving the toner releasability (i.e., reducing the adhesion to the toner) on the outer surface 21*a* of the intermediate transfer belt 21. This decreases the efficiency (second transfer efficiency) with which the toner images are transferred from the intermediate transfer belt 21 to the recording paper 9 at the second transfer position (see the dotted curve in FIG. 7). In this case, as illustrated in FIG. 5, recesses 21*c* are formed at the positions where the fluoropolymer resin particles 5 are lost in the outer surface 21*a* of the intermediate transfer belt 21. It is demonstrated that the external additive deposited on the toner in the two-component developer 8 temporarily enters the recesses 21*c*, although the second transfer efficiency decreases.

Accordingly, the image-forming apparatus 1 according to the first exemplary embodiment uses as the two-component developer 8 a developer containing a toner having an external additive 85 deposited thereon. The external additive 85 is a nonspherical external additive whose volume average particle size AD is smaller than the average particle size AE of the exposed portions of the fluoropolymer resin particles 5*b* in the surface layer 212 of the intermediate transfer belt 21 (AD<AE).

As illustrated in FIG. 3, the particle sizes E of the exposed portions of the fluoropolymer resin particles 5*b* in the surface layer 212 of the intermediate transfer belt 21 are the particle sizes E (E1 to E6) of the portions of the fluoropolymer resin particles 5*b* actually exposed in the outer surface 21*a* of the intermediate transfer belt 21 before use (before they are rubbed by the cleaning blade 27 of the belt-cleaning device 26). The particle sizes E (E1 to E6) of the exposed portions of the fluoropolymer resin particles 5*b* are measured in a scanning electron microscope (SEM) image. The average particle size AE of the exposed portions of the fluoropolymer resin particles 5*b* is an average of measured particle sizes E of exposed portions of about 100 fluoropolymer resin particles 5*b*.

The exposed portions of the fluoropolymer resin particles 5*b* may have an average particle size AE of 200 to 300 nm or about 200 to about 300 nm. If the exposed portions of the fluoropolymer resin particles 5*b* have an average particle size AE of less than 200 nm, they are less effective in reducing the adhesion to the toner after they are abraded by the cleaning blade 27. If the exposed portions of the fluoropolymer resin particles 5*b* have an average particle size AE of more than 300 nm, they are easily abraded by the cleaning blade 27 and come off the outer surface 21*a* of the intermediate transfer belt 21. An intermediate transfer belt 21 in which the exposed portions of the fluoropolymer resin particles 5*b* have an average particle size AE within the above range is manufactured by, for example, a molding process in which an intermediate-transfer-belt forming material containing fluoropolymer resin particles is applied to the circumferential surface of a cylindrical mold. As described above, the fluoropolymer resin particles 5 dispersed in the intermediate transfer belt 21 have an average particle size of 100 to 300 nm.

If the exposed portions of the fluoropolymer resin particles 5*b* in the surface layer 212 of the intermediate transfer belt 21 have an average particle size AE of 200 to 300 nm or about 200 to about 300 nm, the nonspherical external additive 85 deposited on the toner in the two-component developer 8 preferably have a volume average particle size AD of 90 to 180 nm or about 90 to about 180 nm, more preferably 140 to 160 nm or about 140 to about 160 nm, and an average circularity AR of 0.7 to 0.8 or about 0.7 to about 0.8, more preferably 0.77 to 0.8 or about 0.77 to about 0.8.

The volume average particle size AD of the nonspherical external additive 85 is the sphere-equivalent diameter at a cumulative frequency of 50% (D50v) in the distribution of the sphere-equivalent diameters of 100 primary particles of the nonspherical external additive 85 deposited (dispersed) on the toner particles. The sphere-equivalent diameters of the primary particles are determined by capturing images of the primary particles at 40,000× magnification using an SEM, measuring the largest and smallest particle sizes of each primary particle using image analysis, and calculating the sphere-equivalent diameter from the intermediate value (between the largest and smallest particle sizes). If the nonspherical external additive 85 has a volume average particle size AD of 90 to 180 nm or about 90 to about 180 nm, the volume average particle size AD is smaller than the average particle size AE of the exposed portions of the fluoropolymer resin particles 5*b* in the surface layer 212 of the intermediate transfer belt 21 (200 to 300 nm or about 200 to about 300 nm).

If the external additive 85 has a volume average particle size AD of less than 90 nm, it is easily embedded (buried) in the toner particles. If the external additive 85 has a volume average particle size AD of more than 180 nm, it easily comes off the toner particles.

The circularity R of the nonspherical external additive 85 is determined by capturing images of primary particles of the nonspherical external additive 85 deposited (dispersed) on the toner particles under an SEM and calculating the circularity R using image analysis as 100/SF2 by the following equation:

$$\text{Circularity } R = 100/\text{SF2} = 4\pi \times (A/2L)$$

(where A is the projected area ($nm^2$) of the primary particles of the external additive 85, L is the perimeter (nm) of the primary particles of the external additive 85 in the images, and SF2 is the secondary shape factor).

The average circularity AR of the nonspherical external additive 85 is determined as the circularity at a cumulative frequency of 50% in the distribution of the circularities of 100 primary particles determined using the above image analysis.

If the nonspherical external additive 85 has an average circularity AR of 0.7 to 0.8 or about 0.7 to about 0.8, its shape is nonspherical.

If the nonspherical external additive 85 has an average circularity AR of less than 0.7, it might chip due to concentrated stress when locally exposed to a mechanical load. If the nonspherical external additive 85 has an average circularity AR of more than 0.8, it is easily embedded in the toner particles.

The nonspherical external additive 85 may be the inorganic or organic fine particles as described above. For example, the nonspherical external additive 85 may be silica particles or titanium oxide particles, which are hard and chemically stable. The amount of nonspherical external additive 85 added to the toner may be, for example, 2% to 3%.

Thus, the image-forming apparatus 1, which uses as the two-component developer 8 a developer containing the nonspherical external additive 85 having the properties described above, may maintain the efficiency of second transfer of toner images from the intermediate transfer belt 21 to the recording paper 9 after the exposed fluoropolymer resin particles 5*b* come off the intermediate transfer belt 21. The image-forming apparatus 1 may therefore form a high-quality image without image defects due to a decrease in second transfer efficiency.

The mechanism by which the image-forming apparatus 1 may maintain the second transfer efficiency is believed to be as follows.

Figure 6:
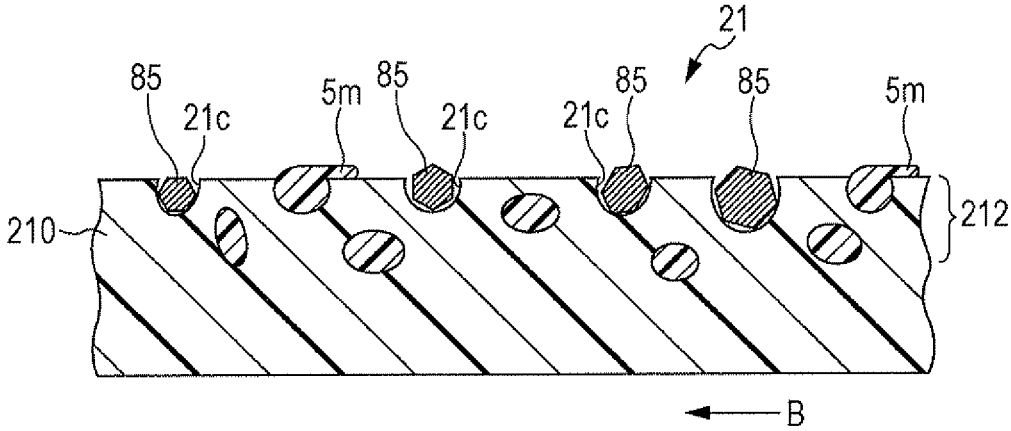
FIG. 6 is a schematic sectional view showing the intermediate transfer belt in FIG. 5 after entry of a nonspherical external additive.

As illustrated in FIG. 6, the nonspherical external additive 85, whose volume average particle size AD is smaller than the average particle size AE of the exposed portions of the fluoropolymer resin particles 5*b* in the surface layer 212 of the intermediate transfer belt 21, may easily enter (be embedded in) the recesses 21*c* formed in the outer surface 21*a* of the intermediate transfer belt 21 at the positions where the fluoropolymer resin particles 5*b* are lost. The nonspherical external additive 85 may remain in the recesses 21*c* without being easily removed by external force such as by rubbing with the cleaning blade 27. As a result, the nonspherical external additive 85 in the recesses 21*c* may function as a supplementary substance for improving the releasability of the toner from the intermediate transfer belt 21 (reducing the adhesion to the toner) instead of the lost fluoropolymer resin particles 5*b*. This may allow the toner images to be smoothly released from the outer surface 21*a* of the intermediate transfer belt 21 at the second transfer position. The recesses 21*c*, which are formed after the fluoropolymer resin particles 5*b* come off, have an opening diameter of, for example, about 0.1 to several micrometers.

Performance Test

Next, a performance test performed on the image-forming apparatus 1 to evaluate the second transfer efficiency will be described.

Figure 7:
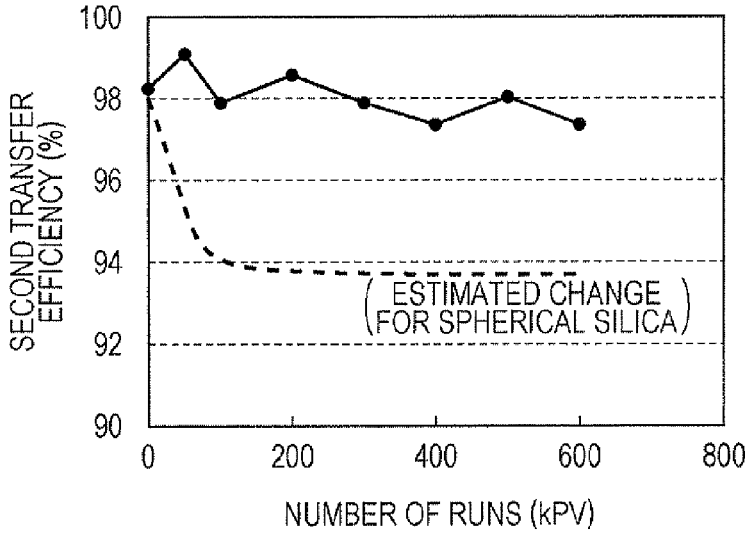
FIG. 7 is a graph showing the results of a performance test on a 10% PTFE intermediate transfer belt.
Figure 8:
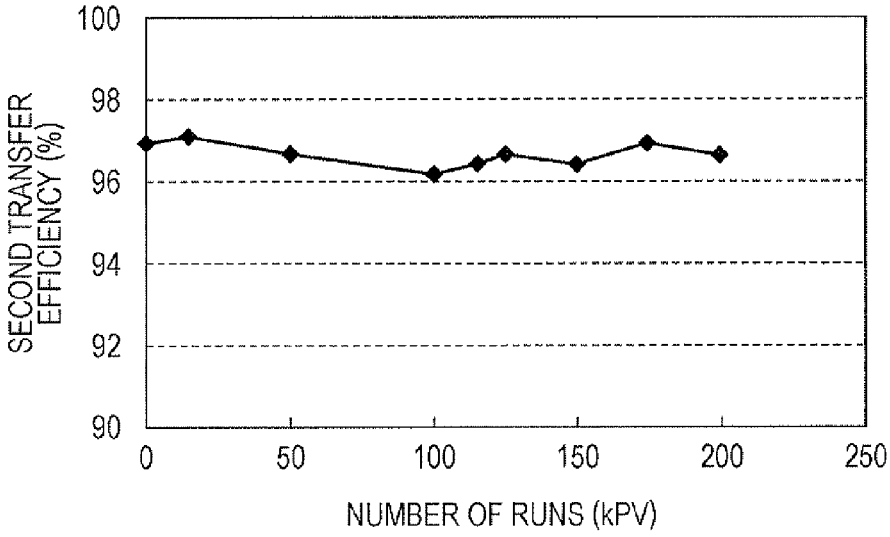
FIG. 8 is a graph showing the results of a performance test on a 30% PTFE intermediate transfer belt.

FIG. 7 shows test results for an image-forming apparatus 1 including an intermediate transfer belt 21 containing 10% of fluoropolymer resin particles 5 (10% PTFE intermediate transfer belt). FIG. 8 shows test results for an image-forming apparatus 1 including an intermediate transfer belt 21 containing 30% of fluoropolymer resin particles 5 (30% PTFE intermediate transfer belt).

In this test, image formation for testing is continuously performed on a predetermined number of sheets of plain paper 9 by transferring and fixing a test image (25 mm×25 mm rectangular patch image with an image area fraction of 240%) developed with the two-component developer 8 described below. The second transfer efficiency is calculated by measuring the mass of the toner that forms the toner image on the intermediate transfer belt 21 before second transfer and the mass of the toner that remains without being transferred after second transfer using a suction device for extremely small amounts of toner. The second transfer efficiency is examined for each image obtained after completion of image formation on a predetermined number of sheets. For the 10% PTFE intermediate transfer belt 21, the image formation is continued to 600,000 runs (=600 kPV). For the 10% PTFE intermediate transfer belt 21, the image formation is continued to 200,000 runs (=200 kPV). This test is performed at a temperature of 25° C. and a humidity of 85% RH (laboratory environment).

The intermediate transfer belts 21 used in the test are two types of intermediate transfer belts 21 fabricated by dispersing 10% or 30% of PTFE particles 5 (average particle size: 100 to 300 nm) in a polyimide endless belt substrate 210 (belt thickness: 0.1 mm). The average particle size AE of the exposed portions of the fluoropolymer resin particles 5 in the outer surface 21*a* of the 10% PTFE intermediate transfer belt 21 before use is 100 to 300 nm. The average particle size AE of the exposed portions of the fluoropolymer resin particles 5 in the outer surface 21*a* of the 30% PTFE intermediate transfer belt 21 before use is 100 to 300 nm.

The belt-cleaning device 26 used in the test includes a polyurethane cleaning blade (thickness: 1.9 mm) set so as to apply a contact load of 30 to 35 N/m to the outer surface 21*a* of the intermediate transfer belt 21. The intermediate transfer belt 21 is rotated at 309 mm/sec in the direction indicated by arrow B.

The two-component developer 8 used in the test contains nonmagnetic toner particles formed of a polyester resin (average particle size: 3.8 μm) and magnetic carrier particles formed of a resin containing a magnetic material such as ferrite or iron powder (average particle size: 35 μm). The two-component developer 8 is prepared with a toner content of 5%. The nonspherical external additive 85 used for the toner is an external additive composed of medium-sized nonspherical silica particles with a volume average particle size AD of 160 μm and an average circularity AR of 0.775, which is deposited on the toner particles.

The results in FIG. 7 demonstrate that the initial second transfer efficiency of the image-forming apparatus 1 including the 10% PTFE intermediate transfer belt 21, i.e., about 98%, decreases only by about 1% up to 600 kPV. The results in FIG. 8 demonstrate that the initial second transfer efficiency of the image-forming apparatus 1 including the 30% PTFE intermediate transfer belt 21, i.e., about 97%, decreases only by about 1% up to 200 kPV.

Material Property Test 1

Next, the fluorine and silica coverages of the outer surfaces 21*a* of the two types of intermediate transfer belts 21 used in the Performance Test are measured at several numbers of runs (numbers of images formed). The measurements (FIGS. 9A and 9B and 10) are used to estimate the changes in the fluorine and silica coverages of the outer surfaces 21*a* of the 10% PTFE intermediate transfer belt 21 and the 30% PTFE intermediate transfer belt 21 at the end.

The fluorine coverage refers to the coverage of the outer surface 21*a* of the intermediate transfer belt 21 with PTFE particles 5 (exposed in the outer surface 21*a*). The silica coverage refers to the coverage of the outer surface 21*a* of the intermediate transfer belt 21 with a nonspherical external additive 85 composed of silica particles (present in the recesses 21*c*). These coverages are measured at an X-ray acceleration voltage of 10 kV/10 mA using an X-ray photoelectron spectroscope (XPS) (JPS-9010 MX, available from JEOL Ltd.). The fluorine coverage is based on the fluorine content of the fluoropolymer resin (fluorine content: 100%) measured using the XPS.

Figure 9A:
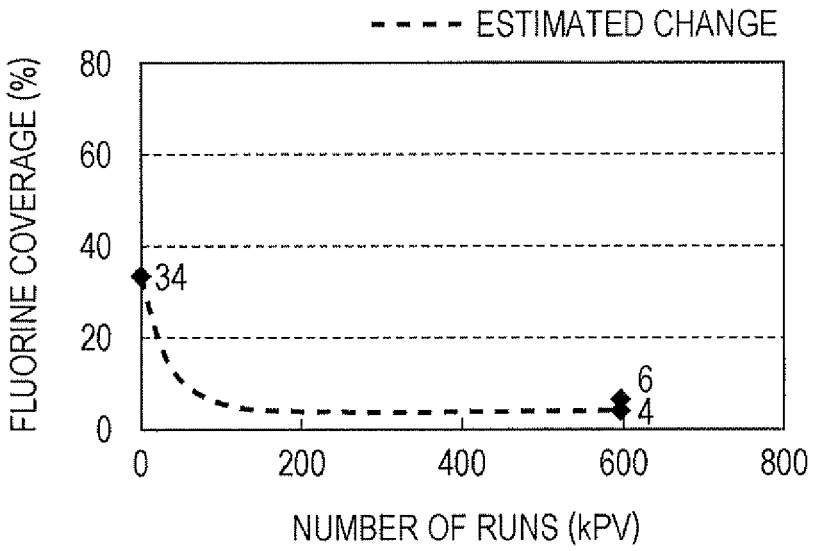
FIGS. 9A and 9B show measurements obtained by Material Property Test 1 on 10% PTFE intermediate transfer belts, where
Figure 9B:
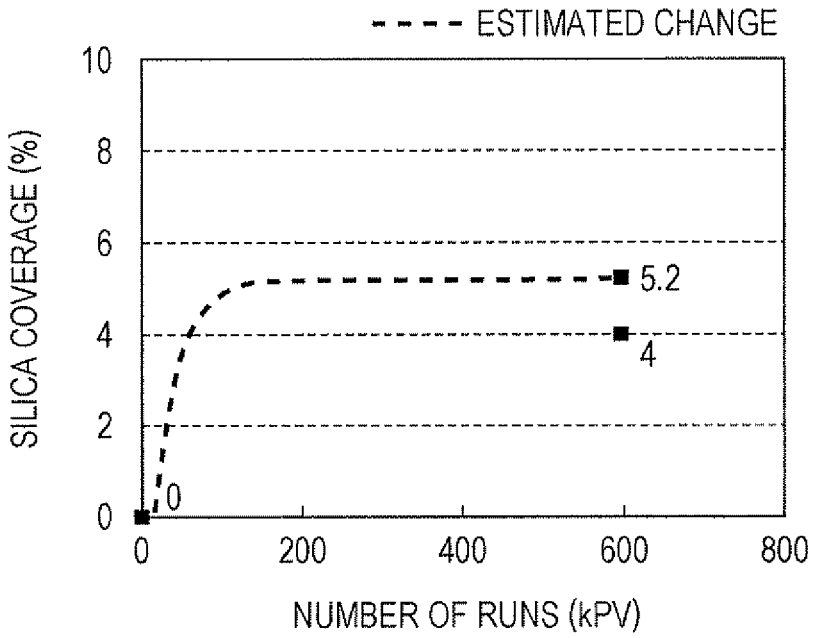
Figure 10:
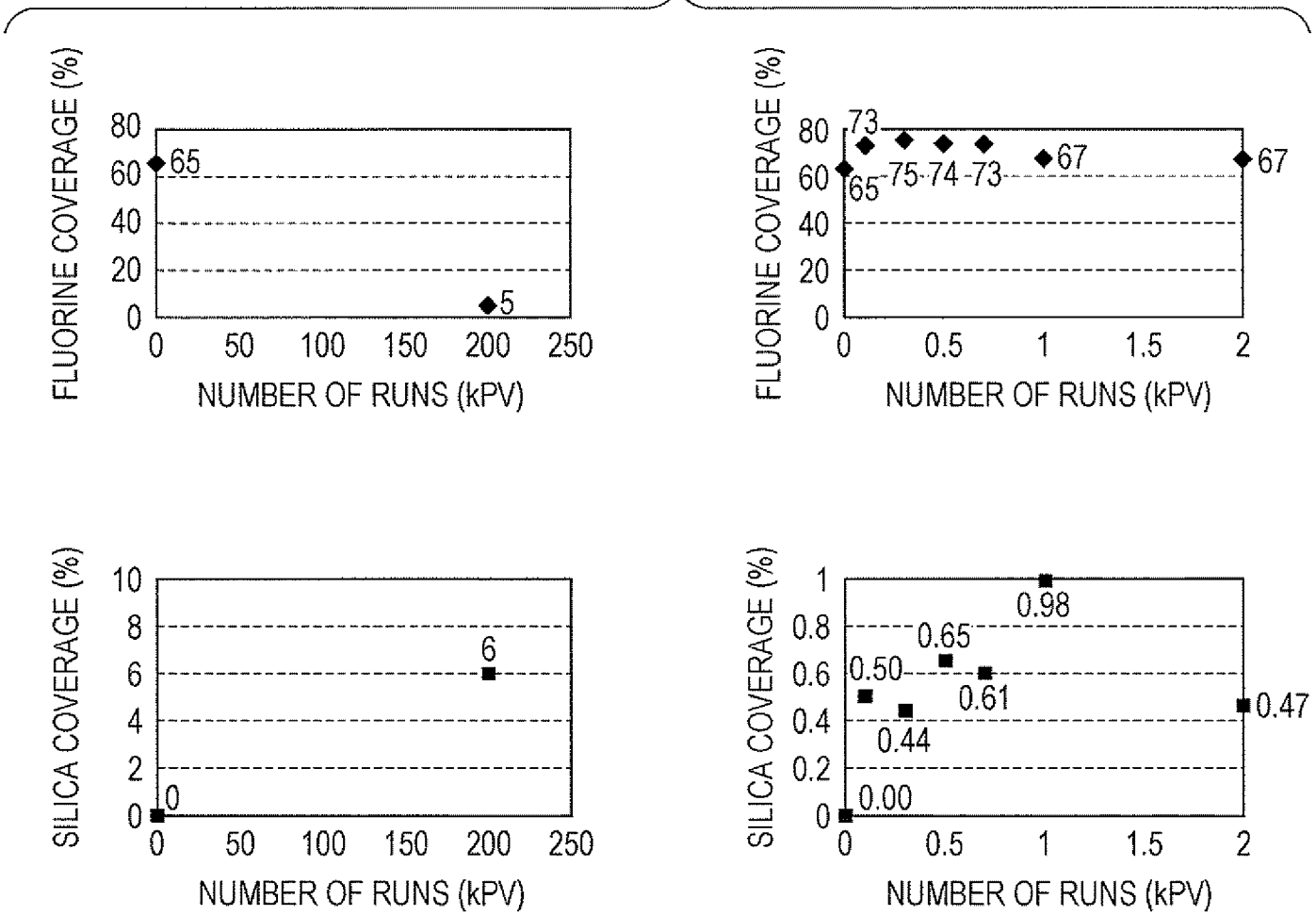
FIG. 10 is a set of graphs showing measurements (fluorine coverage and silica coverage at each number of runs) obtained by Material Property Test 1 on 30% PTFE intermediate transfer belts.

FIGS. 9A and 9B show the measurements of the fluorine and silica coverages of the 10% PTFE intermediate transfer belt 21 at 0 and 600 kPV. The dotted curves in FIGS. 9A and 9B show the estimated changes described later. FIG. 10 shows the measurements of the fluorine and silica coverages of the 30% PTFE intermediate transfer belt 21 at 0 and 200 kPV and at the early stage (0, 0.1, 0.3, 0.5, and 2.0 kPV).

Change in Fluorine Coverage

The fluorine coverage of the 30% PTFE intermediate transfer belt 21 will be discussed first. The measurements of the fluorine coverage at the early stage in the upper right graph in FIG. 10 show that the fluorine coverage decreases from 73% to 67%, i.e., by about 6%, in the range from 0.1 to 2.0 kPV. The rate of decrease is about 3.2%/kPV (=6%/1.9 kPV). The measurements of the fluorine coverage up to 200 kPV in the upper left graph in FIG. 10 show that the fluorine coverage decreases from 65% to 5%. The number of runs at which the fluorine coverage actually decreases to 5% is calculated from the above rate of decrease to be about 19 kPV (=(65%−5%)/(3.2%/kPV)=60/3.2).

Next, the fluorine coverage of the 10% PTFE intermediate transfer belt 21 at 600 kPV in FIG. 9A and the fluorine coverage of the 30% PTFE intermediate transfer belt 21 at 200 kPV in the upper left graph in FIG. 10 are nearly equal, i.e., 5%. This suggests that the fluorine coverage decreases to and remains at about 5%.

Assuming that the above findings apply to the measurements of the fluorine coverage of the 10% PTFE intermediate transfer belt 21 in FIG. 9A, the number of runs at which the fluorine coverage actually decreases to about 5% is calculated from the above rate of decrease to be about 9 kPV (=(34%−4%)/(3.2%/kPV)=30/3.2).

Change in Silica Coverage

The silica coverage of the 30% PTFE intermediate transfer belt 21 will be discussed first. The measurements of the silica coverage at the early stage in the lower right graph in FIG. 10 show that the silica coverage changes from 0.50% through 0.98%, which is the maximum, to 0.47% in the range from 0.1 to 2.0 kPV. The average silica coverage in the range from 0.5 to 2.0 kPV is about 0.6% higher than the silica coverage at 0.0 kPV, and the rate of increase is about 0.3%/kPV (=0.6%/2.0 kPV). The measurements of the silica coverage up to 200 kPV in the lower left graph in FIG. 10 show that the silica coverage increases from 0% to 6%. The number of runs at which the silica coverage actually increases to 6% is calculated from the above rate of increase to be about 20 kPV (=6%/(0.3%/kPV)).

Next, the silica coverage of the 10% PTFE intermediate transfer belt 21 at 600 kPV in FIG. 9B and the silica coverage of the 30% PTFE intermediate transfer belt 21 at 200 kPV in the lower left graph in FIG. 10 are close to each other, i.e., 4.6% (=(5.2+4)/2) to 6%. This suggests that the silica coverage increases to and remains at about 4.6 to 6%.

Assuming that the above findings apply to the measurements of the silica coverage of the 10% PTFE intermediate transfer belt 21 in FIG. 9B, the number of runs at which the silica coverage actually increases to, for example, about 4.6% is calculated from the above rate of increase to be about 15 kPV (=4.6%/(0.3%/kPV)).

Estimated Changes in Fluorine Coverage and Silica Coverage

Based on the above findings, the estimated change in the fluorine coverage of the 10% PTFE intermediate transfer belt 21 in the range from 0 to 600 kPV is added to the measurements of the fluorine coverage of the 10% PTFE intermediate transfer belt 21 in FIG. 9A, where the estimated change is indicated by the dotted curve.

Also, the estimated change in the silica coverage of the 10% PTFE intermediate transfer belt 21 in the range from 0 to 600 kPV is added to the measurements of the silica coverage of the 10% PTFE intermediate transfer belt 21 in FIG. 9B, where the estimated change is indicated by the dotted curve.

Discussion

The estimated change in fluorine coverage in FIG. 9A shows that the fluorine coverage of the 10% PTFE intermediate transfer belt 21 decreases to about 5% at a relatively early stage, i.e., about 9 kPV, and remains the same thereafter. This indicates that the number of fluoropolymer resin particles 5*b* exposed in the outer surface 21*a* of the 10% PTFE intermediate transfer belt 21 tends to decrease considerably at a relatively early stage.

Thus, as more fluoropolymer resin particles 5 are lost, their effect of improving the toner releasability of the intermediate transfer belt 21 decreases, and the second transfer efficiency decreases accordingly.

The estimated change in silica coverage in FIG. 9B shows that the silica coverage of the 10% PTFE intermediate transfer belt 21 increases to about 4.6% to 6% at a relatively early stage, i.e., about 14 kPV, and remains the same thereafter. This indicates that the nonspherical external additive 85 composed of silica particles is present on the outer surface 21*a* of the 10% PTFE intermediate transfer belt 21 at a relatively early stage and remains stably thereafter. As described above, this suggests that the nonspherical external additive 85 enters the recesses 21*c* formed after the fluoropolymer resin particles 5 come off the outer surface 21*a* of the intermediate transfer belt 21 and remains in the recesses 21*c* thereafter.

Thus, a certain amount of nonspherical external additive 85 may be present on the intermediate transfer belt 21 at a relatively early stage and remain thereafter. This may provide the effect of improving the toner releasability (instead of the lost fluoropolymer resin particles 5*b*), thus maintaining the second transfer efficiency irrespective of the decrease in fluorine coverage at a relatively early stage (see FIG. 9A).

Material Property Test 2

Figure 11:
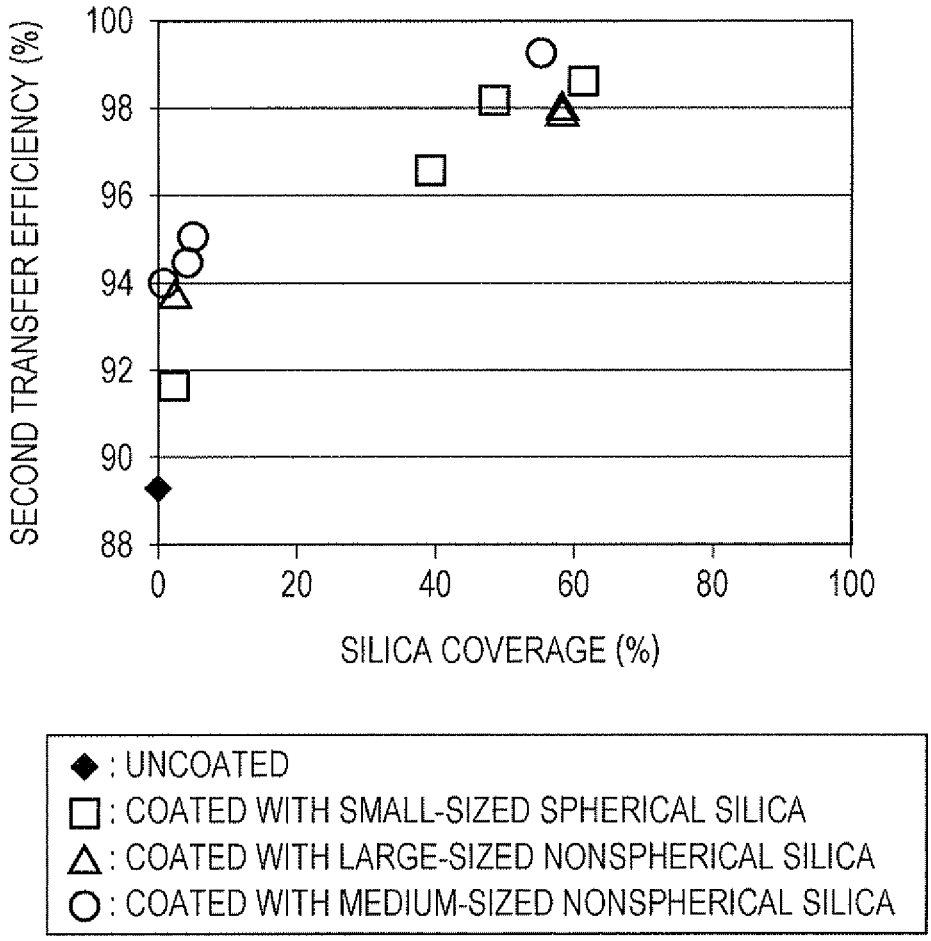
FIG. 11 is a graph showing measurements (silica coverage and second transfer efficiency) obtained by Material Property Test 2 on intermediate transfer belts to which three types of silica external additives are applied.

Next, intermediate transfer belts for testing are fabricated by applying predetermined amounts of the following three types of silica external additives to single-layer intermediate transfer belts (belt substrates 210 in which no fluoropolymer resin particles 5 are dispersed) composed only of a polyimide endless belt substrate (belt thickness: 0.1 mm). The silica coverage and second transfer efficiency of each intermediate transfer belt are then measured, and the relationship therebetween is examined. The silica coverage and the second transfer efficiency are measured by the same measurement procedures as in the Performance Test and Material Property Test 1 described above. In Test 2, the silica coverage and second transfer efficiency of an uncoated single-layer intermediate transfer belt are also measured. The second transfer efficiency is measured immediately after the toner is coated with an external additive. The results of Test 2 are shown in FIG. 11.

(1) Small-sized spherical silica (volume average particle size: 140 nm, average circularity: 0.937)

(2) Large-sized nonspherical silica (volume average particle size: 200 nm, average circularity: 0.808)

(3) Medium-sized nonspherical silica (volume average particle size; 160 nm, average circularity: 0.775)

The results in FIG. 11 show that whereas the uncoated single-layer intermediate transfer belt, in which no PTFE particles 5 are dispersed, exhibits a second transfer efficiency of 89.3%, the intermediate transfer belt coated with the spherical silica external additive to a silica coverage of about 2% exhibits a second transfer efficiency of 92%, and the intermediate transfer belts coated with the nonspherical silica external additives to a silica coverage of about 2% exhibit second transfer efficiencies of about 94%. Thus, the spherical and nonspherical silica external additives yield different results. The results also show that the medium-sized nonspherical silica, which has a lower average circularity, allows for a higher second transfer efficiency. The improvement in second transfer efficiency at a silica coverage of about 2% for the small-sized spherical silica is about half those for the large-sized nonspherical silica and the medium-sized nonspherical silica. As described above, the silica coverage of the 10% PTFE intermediate transfer belt 21, in which 10% of PTFE particles 5 are dispersed, increases to and remains at 4% to 5.2% at 600 kPV (see FIG. 9B).

The second transfer efficiency of the single-layer intermediate transfer belt at the early stage of use is 89.3%, whereas the second transfer efficiency of the 10% PTFE intermediate transfer belt 21 at the early stage of use is 98%. The fluorine coverage of the 10% PTFE intermediate transfer belt 21 decreases considerably at 100 kPV (see FIG. 9A).

Based on the findings on the improvement in second transfer efficiency at a silica coverage of about 2%, the change in the second transfer efficiency of the 10% PTFE intermediate transfer belt 21 in the case where a toner (two-component developer 8) having a spherical silica external additive deposited thereon is estimated and is added to FIG. 7, where the estimated change is indicated by the dotted curve. Specifically, if a spherical silica external additive is used, the second transfer efficiency of the 10% PTFE intermediate transfer belt 21 is estimated to decrease to about 94% because, for example, the spherical silica is embedded in the toner particles. It is demonstrated that if a two-component developer 8 containing a toner having a spherical silica external additive deposited thereon is used to form images, the second transfer efficiency is about 97% at the early stage of use and decreases to about 94% at 100 kPV (in practice, after the developing device idles for about one hour, which is equivalent to about 100 kPV).

Considering the estimated change in second transfer efficiency for the spherical silica external additive also shows that the second transfer efficiency for the nonspherical silica external additive decreases less than that for the spherical silica external additive.

In the results in FIG. 11, the second transfer efficiency is higher for the nonspherical silica than for the spherical silica. This difference in second transfer efficiency presumably results from the fact that more nonspherical silica external additive is deposited on the surface of the intermediate transfer belt than the spherical silica external additive when the second transfer efficiency is measured, thus contributing to improved second transfer efficiency.

FIG. 11 shows the data about the silica coverages and second transfer efficiencies measured immediately after the silica external additives are applied and at 5 kPV after the silica external additives are applied. The data for silica coverages around 2%, which is the data obtained immediately after the silica external additives are applied, shows different second transfer efficiencies depending on the shapes of the external additives. The reason is believed to be as follows. After an external additive is applied, the outer surface 21*a* of the intermediate transfer belt 21 passes through the cleaning blade 27 of the belt-cleaning device 26 before reaching the second transfer section, and the cleaning blade 27 scrapes off a certain amount of silica external additive applied. A spherical silica external additive tends to adhere to the outer surface 21*a* of the intermediate transfer belt 21 that has passed through the cleaning blade 27 less strongly than a nonspherical silica external additive (i.e., more easily collected by the cleaning blade 27).

For reference, FIG. 11 also shows measurements of second transfer efficiency of intermediate transfer belts for testing fabricated by applying larger amounts of the three types of silica external additives described above (to a silica coverage of about 40% to 60%). The intermediate transfer belt to which the spherical silica external additive is applied and the intermediate transfer belts to which the nonspherical silica external additives are applied exhibit similar high second transfer efficiencies (98% to 99%). This demonstrates that a certain amount or more (40% or more in silica coverage) of silica external additive present on an outer surface of an intermediate transfer belt in advance contributes sufficiently to improved transfer efficiency even after some is scraped off by the cleaning blade 27, and therefore, there is little difference in second transfer efficiency due to the particle shape of silica.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer comprising a toner having an external additive deposited thereon, the developer being used with an image-forming apparatus including:

an image carrier including a surface layer in which fluoropolymer resin particles are dispersed; and a cleaning member disposed in contact with an outer surface of the image carrier, wherein the external additive is a nonspherical external additive whose volume average particle size is smaller than the average particle size of exposed portions of the fluoropolymer resin particles in the surface layer of the image carrier.

2. The developer according to claim 1, wherein if the exposed portions of the fluoropolymer resin particles in the surface layer of the image carrier have an average particle size of about 200 to about 300 nm, then the nonspherical external additive has a volume average particle size of about 90 to about 180 nm.

3. The developer according to claim 1, wherein the nonspherical external additive has an average circularity of about 0.8 or less.

4. The developer according to claim 1, wherein the nonspherical external additive is silica particles.

5. The developer according to claim 2, wherein the nonspherical external additive is silica particles.

6. An image-forming apparatus comprising:

a toner image carrier including a surface layer in which fluoropolymer resin particles are dispersed;

an image-forming device that forms on the toner image carrier a toner image with a toner having an external additive deposited thereon; and a cleaning member disposed in contact with an outer surface of the toner image carrier, wherein the external additive deposited on the toner is a nonspherical external additive whose volume average particle size is smaller than the average particle size of exposed portions of the fluoropolymer resin particles in the surface layer of the toner image carrier.

7. The image-forming apparatus according to claim 6, wherein the exposed portions of the fluoropolymer resin particles in the surface layer of the toner image carrier have an average particle size of about 200 to about 300 nm, and the nonspherical external additive has a volume average particle size of about 90 to about 180 nm.

8. The image-forming apparatus according to claim 6, wherein the nonspherical external additive has an average circularity of about 0.8 or less.

9. The image-forming apparatus according to claim 6, wherein the nonspherical external additive is silica particles.

10. The image-forming apparatus according to claim 7, wherein the nonspherical external additive is silica particles.

11. A developer comprising a toner having an external additive deposited thereon, the developer being used with an image-forming apparatus including:

an image carrier including a surface layer in which fluoropolymer resin particles are dispersed; and a cleaning member disposed in contact with an outer surface of the image carrier, wherein the external additive is an external additive that has an average circularity of about 0.8 or less and whose volume average particle size is smaller than the average particle size of exposed portions of the fluoropolymer resin particles in the surface layer of the image carrier.

12. The developer according to claim 11, wherein if the exposed portions of the fluoropolymer resin particles in the surface layer of the image carrier have an average particle size of about 200 to about 300 nm, then the external additive has a volume average particle size of about 90 to about 180 nm.

13. The developer according to claim 11, wherein the external additive is silica particles.

14. The developer according to claim 12, wherein the external additive is silica particles.

15. A method for forming an image, comprising:

forming a toner image with a toner having an external additive deposited thereon on a toner image carrier including a surface layer in which fluoropolymer resin particles are dispersed, wherein the external additive deposited on the toner is a nonspherical external additive whose volume average particle size is smaller than the average particle size of exposed portions of the fluoropolymer resin particles in the surface layer of the toner image carrier.

* * * * *